US007000547B2

(12) United States Patent
Amick

(10) Patent No.: US 7,000,547 B2
(45) Date of Patent: Feb. 21, 2006

(54) TUNGSTEN-CONTAINING FIREARM SLUG

(76) Inventor: Darryl D. Amick, 3227 Countryman Cir., NW., Albany, OR (US) 97321

( * ) Notice: Subject to any disclaimer, the term of this patent is extended or adjusted under 35 U.S.C. 154(b) by 127 days.

(21) Appl. No.: 10/697,600

(22) Filed: Oct. 29, 2003

(65) Prior Publication Data

US 2005/0016411 A1 Jan. 27, 2005

Related U.S. Application Data

(60) Provisional application No. 60/423,331, filed on Oct. 31, 2002, provisional application No. 60/462,164, filed on Apr. 11, 2003.

(51) Int. Cl.
*F42B 7/10* (2006.01)
*F42B 12/72* (2006.01)
*F42B 30/02* (2006.01)

(52) U.S. Cl. ..... 102/501; 102/506; 102/511; 102/517; 102/439

(58) Field of Classification Search ..... 102/448, 102/501, 516, 517, 503, 455; 86/154, 54; 419/38, 65, 66; 75/228, 240, 245, 248; 428/546, 547
See application file for complete search history.

(56) References Cited

U.S. PATENT DOCUMENTS

| | | | |
|---|---|---|---|
| 1,514,908 A | * | 11/1924 | Jannell |
| 1,847,617 A | | 3/1932 | Löwenstein et al. |
| 2,119,876 A | | 6/1938 | Corson |
| 2,183,359 A | | 12/1939 | Smithells |
| 2,775,536 A | | 12/1956 | Fine |
| 2,919,471 A | | 1/1960 | Hechinger |
| 2,995,090 A | | 8/1961 | Daubenspeck |
| 3,123,003 A | | 3/1964 | Lange, Jr. et al. |
| 3,372,021 A | | 3/1968 | Forbes et al. |
| 3,623,849 A | | 11/1971 | Benjamin |
| 3,669,656 A | | 6/1972 | Murphy et al. |
| 3,785,801 A | | 1/1974 | Benjamin |

(Continued)

FOREIGN PATENT DOCUMENTS

| | | |
|---|---|---|
| CA | 521944 | 2/1956 |

(Continued)

OTHER PUBLICATIONS

Li, C.-J., et al., "Enhanced Sintering of Tungsten-Phase Equilibria Effects on Properties," The International Journal of Powder Metallurgy & Powder Technology, vol. 20, No. 2, pp. 149-162 (Apr. 1984).

(Continued)

*Primary Examiner*—Michael J. Carone
*Assistant Examiner*—James S. Bergin
(74) *Attorney, Agent, or Firm*—Kolisch Hartwell, P.C.

(57) ABSTRACT

Firearm slugs formed from a non-toxic lead substitute that includes tungsten. In some embodiments, the firearm slug is formed with a recessed back portion, thus shifting an increased percentage of the slug's net mass toward the front of the slug. In some embodiments, the firearm slug is formed with a recessed front portion. In some embodiments, the slug is a component of a slug cartridge that includes a slug cup. The slug must have a density that is less than, equal to, or greater than lead, or a lead-antimony alloy used for firearm projectiles. In some embodiments, the slug is formed via powder metallurgy from a powder that includes at least one tungsten-containing component and at least one binder. In some embodiments, the slug is cast or otherwise formed from a molten feedstock that includes at least one tungsten-containing component. In some embodiments, the slug is frangible.

43 Claims, 5 Drawing Sheets

U.S. PATENT DOCUMENTS 3,888,636 A 6/1975 Sczerzenie et al.
3,890,145 A 6/1975 Hivert et al.
3,953,194 A 4/1976 Hartline, III et al.
3,979,234 A 9/1976 Northcutt, Jr. et al.
4,027,594 A 6/1977 Olin et al.
4,035,115 A 7/1977 Hansen
4,035,116 A 7/1977 O'Brien et al.
4,043,267 A 8/1977 Hayashi
4,138,249 A 2/1979 Rosof
4,274,940 A 6/1981 Plancqueel et al.
4,338,126 A 7/1982 Vanderpool et al.
4,383,853 A 5/1983 Zapffe
4,428,295 A 1/1984 Urs
4,471,699 A 9/1984 Turco et al.
4,488,959 A 12/1984 Agar
4,587,905 A 5/1986 Maki
4,760,794 A 8/1988 Allen
4,762,559 A 8/1988 Penrice et al.
4,780,981 A 11/1988 Hayward et al.
4,784,690 A 11/1988 Mullendore
4,829,904 A 5/1989 Sullivan
4,864,934 A 9/1989 Theising
4,881,465 A 11/1989 Hooper et al.
4,897,117 A 1/1990 Penrice
4,931,252 A 6/1990 Brunisholz et al.
4,940,404 A 7/1990 Ammon et al.
4,949,644 A 8/1990 Brown
4,949,645 A 8/1990 Hayward et al.
4,960,563 A 10/1990 Nicolas
4,961,383 A 10/1990 Fishman et al.
4,990,195 A 2/1991 Spencer et al.
5,069,869 A 12/1991 Nicolas et al.
5,088,415 A 2/1992 Huffman et al.
5,160,805 A * 11/1992 Winter
5,175,389 A 12/1992 Kramer et al.
5,214,238 A 5/1993 Young
5,263,418 A 11/1993 Dippold et al.
5,264,022 A 11/1993 Haygarth et al.
5,279,787 A 1/1994 Oltrogge
5,339,743 A 8/1994 Scarlata
5,399,187 A 3/1995 Mravic
5,408,931 A 4/1995 Tallman
5,415,102 A 5/1995 White et al.
5,479,861 A 1/1996 Kinchin
5,515,787 A 5/1996 Middleton
5,527,376 A 6/1996 Amick et al.
5,713,981 A 2/1998 Amick
5,719,352 A 2/1998 Griffin
5,737,863 A 4/1998 Rainey, III
5,740,516 A 4/1998 Jiranek, II et al.
5,760,331 A 6/1998 Lowden et al.
5,786,416 A 7/1998 Gardner et al.
5,814,759 A 9/1998 Mravic et al.
5,820,707 A 10/1998 Amick et al.
5,831,188 A 11/1998 Amick et al.
5,847,313 A 12/1998 Beal
5,868,879 A 2/1999 Amick et al.
5,877,437 A 3/1999 Oltrogge
5,894,644 A 4/1999 Mravic
5,905,936 A 5/1999 Fenwick et al.
5,913,256 A 6/1999 Lowden et al.
5,917,143 A 6/1999 Stone
5,922,978 A 7/1999 Carroll
5,950,064 A 9/1999 Robinson et al.
5,963,776 A 10/1999 Lowden et al.
6,048,379 A 4/2000 Bray et al.
6,067,909 A 5/2000 Knoster, Jr.
6,090,178 A 7/2000 Benini
6,105,506 A 8/2000 Gangale
6,136,105 A 10/2000 Spencer
6,182,574 B1 * 2/2001 Giannoni ..... 102/516
6,248,150 B1 6/2001 Amick
6,257,149 B1 * 7/2001 Cesaroni ..... 102/517
6,270,549 B1 8/2001 Amick
6,367,387 B1 4/2002 Krüper
6,371,029 B1 4/2002 Beal
6,385,887 B1 5/2002 Johnston
6,405,654 B1 6/2002 Smith
6,439,124 B1 * 8/2002 Enlow et al. ..... 102/501
6,447,715 B1 9/2002 Amick
6,453,820 B1 9/2002 Anderson
6,457,417 B1 10/2002 Beal
6,502,516 B1 1/2003 Kinchin
6,527,824 B1 3/2003 Amick
6,527,880 B1 3/2003 Amick
6,530,328 B1 * 3/2003 Burczynski et al. ..... 102/516
6,546,875 B1 4/2003 Vaughn et al.
6,551,375 B1 4/2003 Siddle et al.
6,551,376 B1 4/2003 Beal
6,581,523 B1 6/2003 Beal
6,591,730 B1 7/2003 Beal
6,805,057 B1 * 10/2004 Carr et al.
6,845,719 B1 * 1/2005 Spencer
2002/0124759 A1 9/2002 Amick
2002/0178963 A1 12/2002 Halverson
2003/0027005 A1 2/2003 Elliott
2003/0161751 A1 8/2003 Elliott
2003/0164063 A1 9/2003 Elliott

FOREIGN PATENT DOCUMENTS

GB 2149067 6/1985
JP 52-68800 6/1977
JP 59-6305 1/1984
JP 1-142002 6/1989
WO WO 00/37878 6/2000

OTHER PUBLICATIONS

Sykes, W. P., "The Iron-tungsten System," Meeting of the American Institute of Mining and Metallurgical Engineers, New York, pp. 968-1008 (Feb. 1926).

* cited by examiner

TUNGSTEN-CONTAINING FIREARM SLUG

RELATED APPLICATIONS

This application claims priority to and the benefit of U.S. Provisional Patent Applications Nos. 60/423,331, filed Oct. 31, 2002, and 60/462,164, filed Apr. 11, 2003, the contents of which are hereby incorporated by reference.

FIELD OF THE DISCLOSURE

The present disclosure is directed generally to firearm projectiles, and more particularly to tungsten-containing firearm slugs.

BACKGROUND

Conventionally, many articles have been produced from lead because of its relatively high density (11.3 g/cc), high workability, and inexpensive cost. In particular, firearm projectiles have almost exclusively been produced from lead or an alloy of lead and a small percentage of antimony. Because of the toxicity of lead, efforts have been made to discover lead substitutes. In 1996, the U.S. Fish and Wildlife Service banned the use of lead shotgun shot for hunting waterfowl, thus prompting an immediate need to discover appropriate lead alternatives for shotgun shot. Furthermore, lead alternatives for other firearm projectiles, such as firearm slugs, were sought.

SUMMARY OF THE DISCLOSURE

The present disclosure is directed to firearm slugs formed from a non-toxic lead substitute that includes tungsten. In some embodiments, the firearm slug is formed with a recessed back portion, thus shifting an increased percentage of the slug's net mass toward the front of the slug. In some embodiments, the firearm slug is formed with a recessed front portion. In some embodiments, the slug is a component of a slug cartridge that includes a slug cup. In some embodiments, the slug has a density less than lead, in some embodiments the slug has a density equal to lead or a lead-antimony alloy that is conventionally used for firearm projectiles, and in some embodiments, the slug has a density that is greater than lead. In some embodiments, the slug is formed via powder metallurgy from a powder that includes at least one tungsten-containing component and at least one binder. In some embodiments, the slug is cast or otherwise formed from a molten feedstock that includes at least one tungsten-containing component. In some embodiments, the slug is frangible, while in others it is infrangible.

DETAILED DESCRIPTION AND BEST MODE

Figure 1:
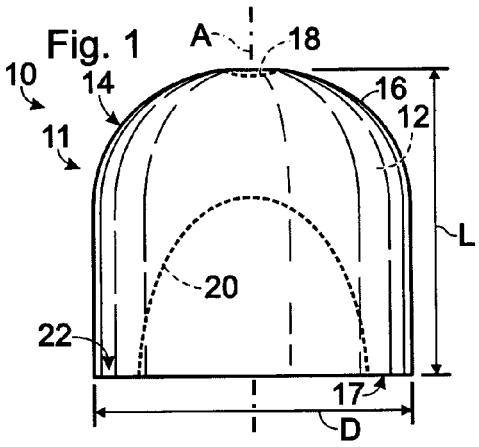
FIG. 1 is an elevation view of a firearm slug formed from a lead substitute according to the present disclosure.

The present disclosure is directed to firearm slugs 10 that contain a tungsten-containing component and which are at least substantially, if not completely, lead free. As used herein, the terms "slug," "shot slug," and "firearm slug" are meant to refer to the single projectile that is fired from a slug cartridge, or shotgun cartridge. Slug cartridges typically include a plastic or other non-metal hull within which a shot slug is contained before the cartridge is fired. Slugs according to the present disclosure may be designed to be fired out of smooth bore or rifled shotguns or other firearms designed to receive and fire slug cartridges.

Shot slugs are distinguishable from shotgun shot or pellets, of which a plurality of individual units will be placed in a shotgun shell and fired at the same time. Furthermore, whereas individual pellets are typically dimensioned with a significantly smaller diameter than the inner diameter of the barrel from which they are fired, a slug may be dimensioned to more closely correspond to the barrel so that the barrel may ballistically control the slug. In other words, the slugs tend to be larger in diameter than pellets, thereby limiting lateral movement within a barrel when the slug is fired. In some embodiments, the slugs may be configured to engage rifling of the barrel (when fired from a firearm with a rifled barrel), thereby increasing the ballistic control of the slug.

A barrel may ballistically control a slug that has been sized to itself closely correspond to the inner diameter of the barrel, or a barrel may ballistically control a slug that has been sized so that a slug cup or sabot surrounding the slug closely corresponds to the inner diameter of the barrel. Shot slugs (or shot slugs with corresponding shot cups or sabots) typically have a diameter that is at least 80% the diameter of the barrel from which the slug is fired, with diameters of at least 90%, or even 95% to almost 100%, being more common. Shot slugs and their corresponding cartridges may be configured to be fired from shotguns that can also fire conventional shotgun shot or pellets. In further contrast to conventional shot and shot pellets, shot slugs have a defined orientation relative to the long axis of the barrel of the firearm from which they are fired. More specifically, shot slugs have defined forward and rearward ends. Therefore, while slugs may rotate about their longitudinal axes, the relative positions of these ends are not reversible as the slug travels within the firearm barrel. Shot slugs are also distinguishable from bullets, which are fired from pistols or rifles and which are at least partially surrounded by metal casings in the cartridge on account of the higher pressure and velocity that are typically encountered when the bullet cartridges are fired by these types of firearms.

Firearm slug 10 is constructed from at least a tungsten-containing component, and this tungsten-containing component often forms a majority component of the slug. Preferably, the tungsten-containing component is, or forms part of, a non-toxic lead substitute. However, it is within the scope of the present disclosure that slug 10 may be formed from a tungsten-containing component (and optionally other components that are described, illustrated and/or incorporated herein), which do not fall within the preferred classification of a non-toxic lead substitute.

Slugs 10 preferably are constructed from a non-toxic lead substitute (NTLS) 12. NTLS 12 preferably does not contain any lead, but it is within the scope of the disclosure that NTLS 12 may include some lead so long as the lead component does not raise the toxicity of the NTLS beyond an acceptable level, such as may be established by state, federal, or other regulatory or advisory agencies. As discussed in more detail herein, the slugs may be formed via a variety of processes, including via powder metallurgy by compacting a solid powder form of NTLS 12, with or without heating or sintering. Another suitable process is by forming a molten feedstock containing NTLS 12 and then casting the slugs from this molten feedstock, either directly or by casting an intermediate structure and then forming the slug from the intermediate structure.

As discussed in more detail below, the NTLS may be formed from various proportions and particle sizes of constituent components, which may be combined using any suitable procedure for forming and/or blending solid, powder-form components. In particular, the NTLS includes tungsten, which has a density of 19.3 g/cc and which therefore is much higher than the density of lead, and at least one binder. The tungsten may be described as being a tungsten-containing component, which may include pure tungsten, tungsten alloys and/or compounds that contain tungsten. Illustrative, non-exclusive examples of suitable tungsten alloys and compounds include W—Cu—Ni, W—Co—Cr, W—Ni—Fe, W—Ni, WC (tungsten carbide), W—Fe (ferrotungsten) and alloys of tungsten and one or more of nickel, zinc, copper, iron, manganese, silver, tin, bismuth, chromium, cobalt, molybdenum and alloys formed therefrom, such as brass and bronze. Illustrative examples of suitable binders include one or more of a polymeric binder (which typically needs to be cured or otherwise actuated) and a metallic binder. Examples of polymeric binders include thermoplastic and thermoset polymers, including flexible, or rigid, epoxies. Examples of suitable metallic binders include tin, tin alloys or other comparatively soft metals. Because of the comparably high density of tungsten, a NTLS 12 may be used to produce a firearm slug with a higher density than a lead firearm slug. Increasing the mass of a firearm slug increases the down-range energy of the slug compared to a similarly dimensioned slug formed from a lower density composition. It also offers the option of providing a shorter slug, which may provide increased gyroscopic stability when fired from rifled barrels.

However, and as discussed in more detail herein, it is also within the scope of the disclosure to produce a firearm slug with a density that is less than the density of lead, such as a density in the range of 8 g/cc to 11.2 g/cc or a density in the range of 9 g/cc to 11 g/cc. Other illustrative densities and density ranges that are within the scope of the present disclosure include a density that equals the density of lead or a lead-antimony alloy that is conventionally used in firearm projectiles, such as a density of 11.3 g/cc (lead), 11.2 g/cc (lead with 1–2 wt % antimony), 11.1 g/cc (lead with 3–4 wt % antimony), or 10.9 g/cc (lead with 6 wt % antimony), and a density that is greater than the density of lead, such as a density in the range of 11.5 g/cc to 17 g/cc, a density in the range of 11.5 g/cc to 13 g/cc, a density of at least 12 g/cc, and a density in the range of 12 g/cc and 15 g/cc.

Examples of firearm slugs constructed according to the present disclosure are shown in FIGS. 1–6 and indicated generally at 10. More particular illustrative embodiments are shown in FIGS. 1–4 at 11, in FIG. 5 at 30, and in FIG. 6 at 50. In the following discussion, references to slug 10 refer generally to any firearm slug according to the present disclosure and therefore include, but are not limited to, the illustrative embodiments depicted as slugs 11, 30 and 50. Furthermore, the illustrative embodiments (11, 30 and 50) are provided to illustrate exemplary configurations, with the elements, subelements, variations, and alternatives discussed herein being applicable, but not required, to any of the illustrative embodiments or other slugs described, incorporated and/or illustrated herein. Similarly, and for the purpose of brevity, similar elements of the various illustrative embodiments, including variations thereto, will not be represented and discussed with each illustrative example depicted herein but remain within the scope of the present disclosure.

Figure 2:
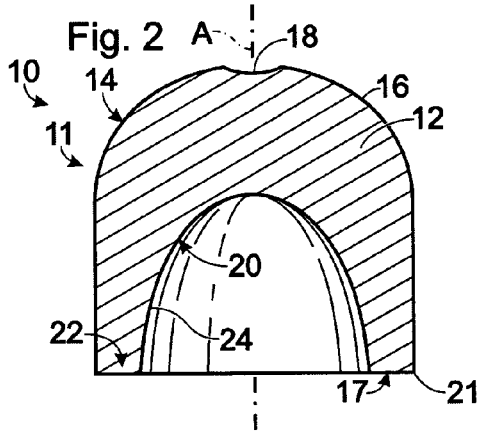
FIG. 2 is cross-sectional view of the firearm slug of FIG. 1.
Figure 3:
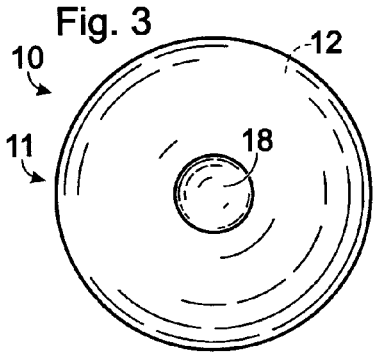
FIG. 3 is a top plan view of the firearm slug of FIG. 1.
Figure 4:
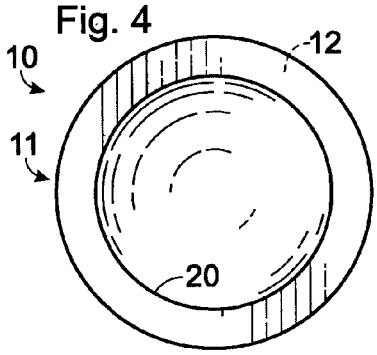
FIG. 4 is a bottom plan view of the firearm slug of FIG. 1.

As shown in FIGS. 1 and 2 with reference to slug 11, firearm slugs 10 according to the present disclosure include a body 14 having a nose, or forward region, 16 and a base, or rearward region, 17. As used herein, the forward region refers to the portion of the slug that is designed to first leave the barrel of a firearm from which the slug is fired. Similarly, the base, or rearward region refers to the portion of the slug that is oriented toward the primer and propellant in a firearm cartridge and thereby is the last portion of the slug to leave the firearm barrel. In the illustrated embodiment, the nose or forward region of the slug has a tapered, generally convex configuration, and the base or rearward region defines a flat, or generally planar, region.

As perhaps best seen in FIG. 2, slug 11 also includes a front internal recess 18 formed in forward region 16 and a rear internal recess 20 formed in rearward region 17. It is within the scope of the disclosure, however, that slugs 10 according to the present disclosure may include only one of recesses 18 and 20, such as only a front internal recess, or more typically, only a rear internal recess. It is also within the scope of the disclosure that a slug may be formed without a front or rear recess, and in some embodiments, the slug may be shaped with other physical features.

The front and rear internal recesses, when present, may be variously dimensioned. A particular size and shape of a particular recess may be chosen to impart the slug with desired characteristics. For example, a relatively large rear internal recess 20, such as shown in FIGS. 1 and 2 with respect to slug 11, decreases the mass near the rear of the slug compared to a slug of comparable size and composition, thus increasing the relative proportion of mass near the front of the slug. A forward-weighted slug may facilitate a truer flight, thus increasing the accuracy of the projectile. A relatively large rear internal recess also increases the proportion of mass near the perimeter of the slug, thereby increasing the moment of inertia of the slug about the slug's longitudinal axis A. A slug with a relatively high moment of inertia is better suited to resist angular acceleration. In the illustrative example shown in FIGS. 1 and 2, rear recess 20 extends more than halfway between the nose and base of the slug. It is within the scope of the disclosure that the rear recess, when present, may extend to different depths, or extents, within the slug, including greater and lesser depths than shown in the illustrative example. For example, rear recess 20 may extend at least approximately 20% of the distance between the nose and base of the slug, such as within ranges of 20%–75% of the distance or 25%–50% of the distance. Expressed in other words, the rear recess 20 may extend into body 14 from base 17 at least one of the above percentages or ranges of percentages of the length of the slug, which is measured between the slug's nose and base, as indicated at L in FIG. 1.

As perhaps best seen in FIG. 2, body 14 of the slug includes a skirt 22, which extends radially outward from the longitudinal axis A of the slug from rear recess 20 to the outer perimeter 21 of the slug's body. The thickness of skirt 22, which defines, at least in part, the sidewalls 24 of rear recess 20, may be sized to increase the effectiveness of the slug. In particular, the skirt is typically designed thick enough to allow the slug to remain intact when fired. The skirt also may be tapered to help improve the structural stability of the slug. An initial skirt thickness (at base 17) of approximately 1/16 inch has been found to be effective, although a lesser or greater thickness may be used within the scope of the disclosure. For example, the skirt may be sized with an initial thickness in the range of approximately 1/32 inch to approximately 1/4 inch or more. It should be understood that there is a relationship between the thickness of the skirt and the width of the recess, with thicker skirts corresponding to narrower recesses for the same diameter of slug.

A front recess, such as indicated at 18 in FIG. 1, may further increase flight trueness. Furthermore, the front recess may promote expansion and/or fragmentation of the slug when it strikes a deformable target. When hit, the deformable target may flow into the recess, thus creating a force in the recess that may cause the slug to expand from the recess outward. The forward and/or rear recesses may be shaped with smooth curving surfaces that may help limit mechanical stress on the slug, which may cause the slug to undesirably fragment or otherwise break apart in larger component pieces. By this it is meant that the slug breaks into a discrete number of pieces, such as less than approximately twenty and often less than ten or five components, excluding particulate. As shown in FIG. 2, front recess 18 and rear recess 20 both are gradually curved, avoiding sharp corners and ledges that may act as stress points. It is within the scope of the disclosure that the slugs may be further configured to lessen stress, such as by smoothing the transition between the surface of a recess and the adjacent outer surface of the slug. It is also within the scope of the disclosure to shape the slug with sharp corners and/or ledges, if for example the ease of manufacturing such a slug outweighs the potential benefits of limiting sharp edges or if a particular application for the slug makes it desirable for the slug to fragment into larger component pieces upon impact.

In FIGS. 1 and 2, front recess 18 defines a region of concavity in the nose of the slug. Similar to the rear recess, the width and depth of the front recess, when present in a slug 10, may vary within the scope of the disclosure from the illustrative example shown in FIGS. 1 and 2. When present, the front recess will typically have a diameter or width (depending upon the particular geometry of the recess) that is at least 5% of the diameter of the slug, and often which is at least 10–20% or more of the diameter D (as indicated in FIG. 1) of the slug. Similarly, the depth of the front recess will typically be at least 5% of the length L of the slug, and often will be in the range of 2%–25%, 5%–15%, or 5%–40% or more of the length of the slug. In some embodiments, a front recess and a rear recess may extend into one another, thereby providing a somewhat toroidal slug having an inner channel.

Figure 5:
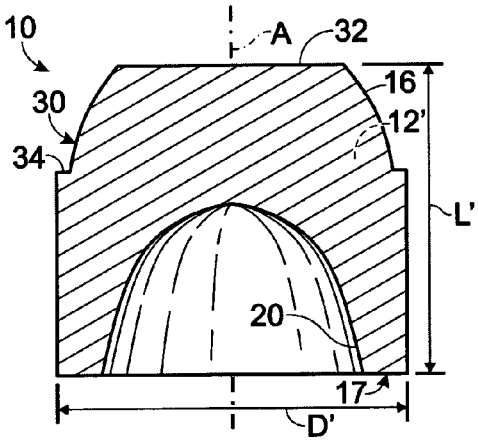
FIG. 5 is an elevation view of another firearm slug formed from a lead substitute according to the present disclosure.
Figure 6:
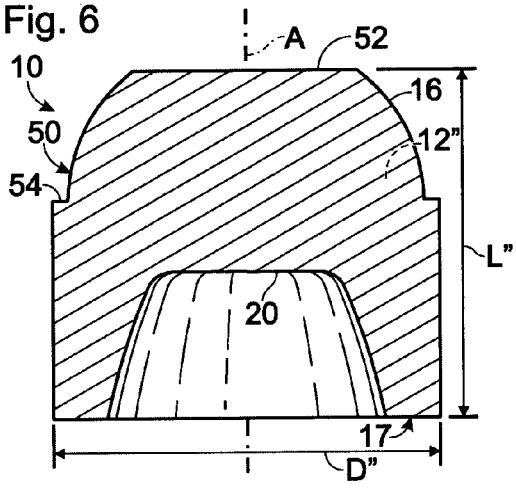
FIG. 6 is an elevation view of another firearm slug formed from a lead substitute according to the present disclosure.

As indicated in FIGS. 1, 5 and 6, the slugs each have a diameter, which may be sized to correspond to a particular diameter of firearm barrel. The individual diameters of slugs 11, 30 and 50 have been respectively indicated at D, D' and D" in FIGS. 1, 5 and 6. Slugs with greater diameters are compatible with firearm barrels having relatively large bores, while slugs with lesser diameters are compatible with firearm barrels having relatively small bores. Therefore, a particular slug diameter may be sized to correspond to firearms of a particular gauge or caliber. It is within the scope of the disclosure to construct slugs for virtually any size and/or type of firearm. As described herein, the actual diameter of the slug may be smaller than the bore of the firearm, to accommodate a slug cup or sabot. Similarly, the particular length L of a slug along the longitudinal axis A may be sized to accommodate a particular type of firearm and/or shooting application. To illustrate that slugs 10 according to the present disclosure may have a variety of lengths, slugs 30 and 50 are illustrated in FIGS. 5 and 6 with lengths L' and L". Slugs having relatively shorter lengths have proven to exhibit favorable accuracy attributes. Therefore, slugs according to some embodiments of the present disclosure may be designed to have a length L that is no greater than (less than or equal to) the corresponding diameter D of the slug. It is within the scope of the disclosures that a slug 10 may alternatively have a length L that exceeds the diameter D of the slug.

As discussed, the firearm slug 10 shown at 11 in FIGS. 1–4 is but an illustrative example of firearm slugs that may be constructed according to the present disclosure. For example, and as also discussed above, the relative dimensions of the slug, including its length and width, as well as the number of recesses (if any) and dimensions of the recess(es) may vary without departing from the scope of the disclosure.

Another illustrative example of a firearm slug 10 constructed according to the present disclosure is shown in FIG. 5 and specifically indicated at 30. Like the previously illustrated slugs, slug 30 is produced from a NTLS 12', which may be the same NTLS used to produce slug 11, or a different NTLS. As shown in FIG. 5, slug 30 is dimensioned differently than the previously illustrated slug 11. For example, slug 30 is an example of a slug that does not include a front recess 18. Perhaps more particularly, slug 30 also demonstrates an example of a slug that includes a nose, or forward region, 16 having a blunt, or flat, tip 32. Slug 30 also demonstrates that it is within the scope of the disclosure for slugs to include a shoulder 34 generally between the nose and base of the slug. By "generally between," it is meant that the shoulder is located anywhere between the tip of the nose portion and the distal portion of the base portion. In other words, the shoulder portion does not need to exactly equally spaced between the nose portion and the base portion.

FIG. 6 shows still another example of a slug produced from a NTLS 12", yet having a shape different than the previously illustrated slugs. Similar to NTLS 12', NTLS 12" may have the same or different composition as the NTLS used to produce slug 11. Slug 50 also provides an additional example of a slug 10 that includes a flat nose portion, such as indicated at 52, and a shoulder 54. Slug 50 also graphically illustrates that slugs 10 according to the present disclosure may include rear recesses 20 having configurations other than the tapered configuration shown in FIGS. 1–5. It should be understood that slugs 11, 30, and 50 are provided as illustrative, non-limiting examples, and slugs with different shapes are within the scope of the disclosure.

Figure 7:
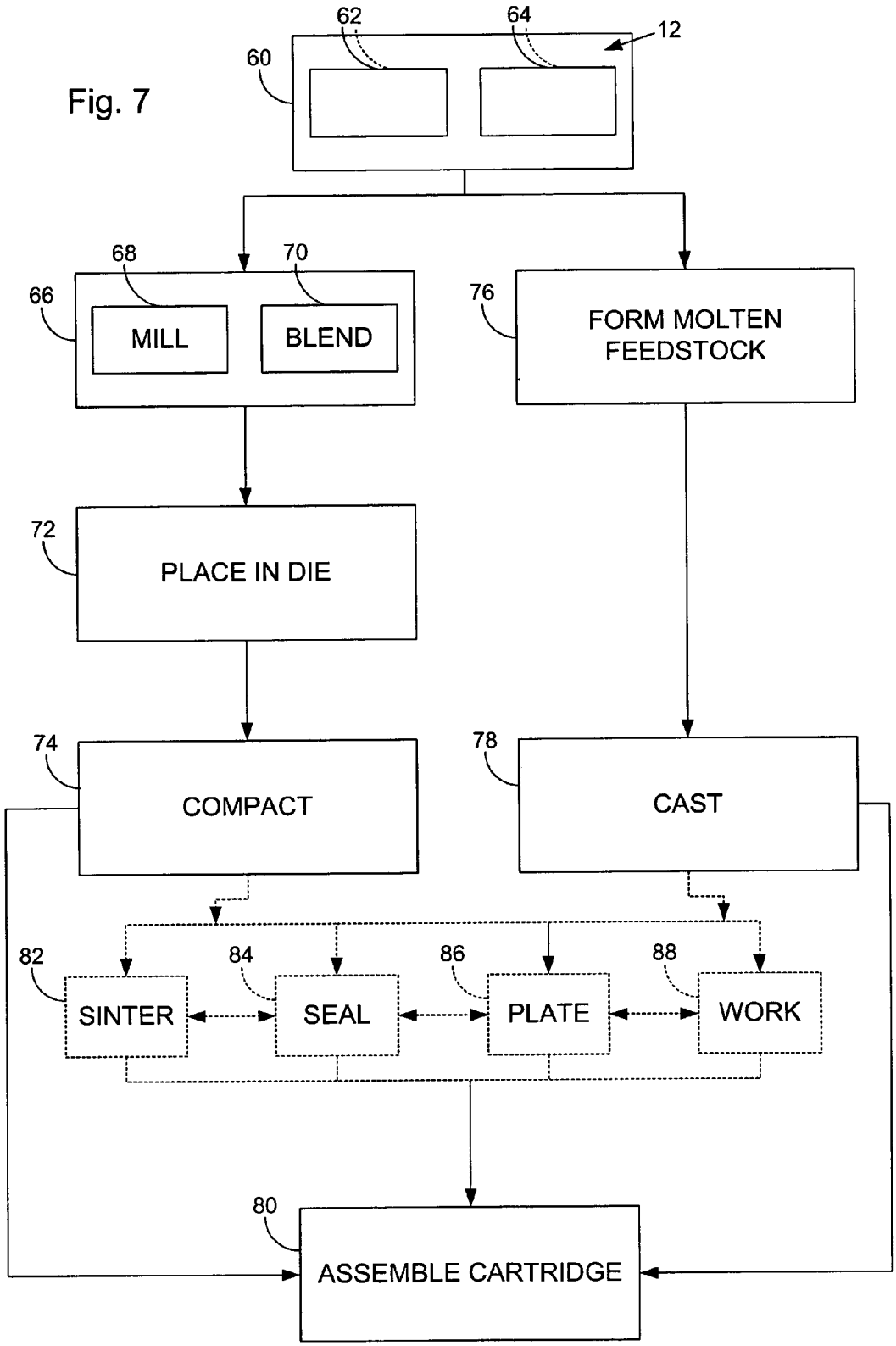
FIG. 7 is a flowchart schematically depicting examples of suitable methods for forming firearm slugs according to the present disclosure.

As discussed, slugs 10 according to the present disclosure may be formed from a variety of compositions, including NTLS 12, and by a variety of methods or techniques. Illustrative examples of these methods are shown in FIG. 7. For example, at 60, the components to be used in slug 10 are assembled. As discussed, slug 10 preferably includes a NTLS 12, and it is within the scope of the disclosure that slug 10 is at least substantially, or even completely, formed from NTLS 12. In FIG. 7, NTLS 12 is shown including at least one tungsten-containing component 62 and at least one binder, or binder component, 64. NTLS 12 may also include a relatively small percentage of a suitable lubricant, such as polyethylene, ACRAWAX™ or KENOLUBE™.

Two illustrative examples of methods for forming a slug 10 according to the present disclosure include forming the slug via powder metallurgy and forming the slug by casting a molten feedstock. When powder metallurgy is used, at least the tungsten-containing component of the NTLS is in powder form. As used herein, the term "powder" is meant to include particulate having a variety of shapes and sizes, which may include generally spherical or irregular shapes, flakes, needle-like particles, chips, fibers, equiaxed particles, etc. The binder may also be in powder form, but it is also within the scope of the disclosure to use binders that are not in particle form. The solid components are then mixed together, as indicated at 66. This mixing may include blending the components together and/or milling the components, as schematically illustrated at 68 and 70. When milling 68 is used, any suitable milling process, including high-energy milling, may be utilized. At 72, the mixed components are placed into a die, and then compacted at 74 to form the slug or an intermediate structure from which slug 10 is formed.

When slug 10 is formed by casting a molten feedstock, it should be understood that NTLS and/or any other components of slug 10 may be present in any suitable powder or larger form. At 76, a molten feedstock is formed. At 78, the molten feedstock is cast to form slug 10 or an intermediate structure from which slug 10 is formed.

As indicated above, after the compressing or casting steps, it is within the scope of the disclosure to have a finished slug 10, which is ready to be assembled into a slug cartridge, or shotgun shell, as indicated at 80. However, it is also within the scope of the disclosure that the compacted or cast structures will receive some additional processing prior to assembly of the slug cartridge or shotgun shell. Several illustrative examples of these additional processing steps will be described below and are indicated in dashed lines in FIG. 7. It is within the scope of the disclosure that none of these steps may be utilized, that only one of these steps may be utilized, that two or more of these steps may be utilized, and that one or more additional processing steps may be utilized either alone or in addition to one or more of the subsequently described steps.

As indicated in FIG. 7 at 82, the compacted structure may be sintered. Sintering typically forms a harder slug, while also reducing the frangibility of the slug. Therefore, if a frangible slug is desired, extensive sintering (liquid or solid phase) probably will not be used, although it is still within the scope of the disclosure to provide some sintering or other heating of the slug.

As indicated at 84, the compacted or cast structure may be sealed, and as indicated at 86, the structure may be plated. Sealing is a method of applying a liquid to the compacted or cast structure and then purposefully infiltrating or otherwise urging the liquid into the pores of the structure. Plating refers to applying a surface coating to the slug, typically of a metal, such as copper or copper alloys. Therefore, unlike a plating process, which is designed to apply a surface coating, a sealing process includes urging the sealant into the pores of the compacted or cast structure. As discussed in more detail herein, the sealing process may or may not also include providing the compacted or cast structure with a surface coating. Both sealing and plating processes will tend to increase the overall strength of the compacted or cast structure. However, a sealing process includes increasing the internal strength of the structure because the sealant is purposefully forced into the subsurface region of the compacted or cast structure, while a plating process increases the external strength of the compacted or cast structure by providing an external cover around the structure. Both plating and sealing also protect the slug or intermediate structure from having particulate removed, abraded or otherwise dislodged therefrom, such as during handling, other subsequent processing steps, packaging, assembly into slug cartridge, etc. When the NTSL used to form the slug is abrasive, such as tungsten carbide or ferrotungsten, the retention sealing and/or plating steps also protect the manufacturing and other equipment used to manufacture, transport and/or package the slugs from being damaged by abrasive powder or particulate that may be removed from the slugs or intermediate structures. When the slug is going to be sealed and plated, it may be desirable, or with some combinations of polymeric sealants and metallic plating materials, to wash or otherwise remove the sealant from the outer surface of the slug before plating the slug.

As indicated at 88, the compacted or cast structure may be worked, such as by being plastically deformed from a near net shape to the final desired slug shape, to apply grooves or other surface characteristics, etc. This working step may provide some additional densification to the intermediate structure, such as when the structure is plastically deformed.

When powder metallurgy is used, the compacted structure may be reformed after the initial compaction step and/or after the additional processing steps. Reforming refers to compacting the structure again (typically with at least one differently shaped die, punch or other tool) to achieve a different shape, which in the present application refers to the shape (or near net shape) of slug 10. When the intermediate structure is designed to be reformed, the NTLS used to form the structure should be sufficiently ductile to survive the reforming step. In other words, the compacted structure should be sufficiently ductile to be reshaped through the application of pressure (typically after insertion of the compacted structure into a different die) to form the new shape and retain a unitary structure.

Figure 8:
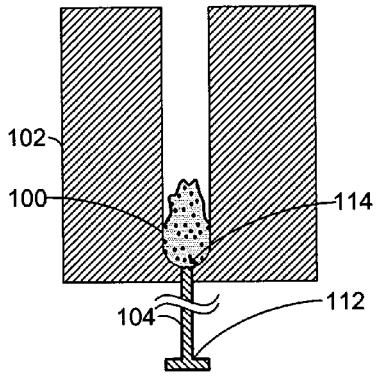
FIGS. 8 and 9 are schematic representations of a compacting process used to press slugs according to the present disclosure.
Figure 9:
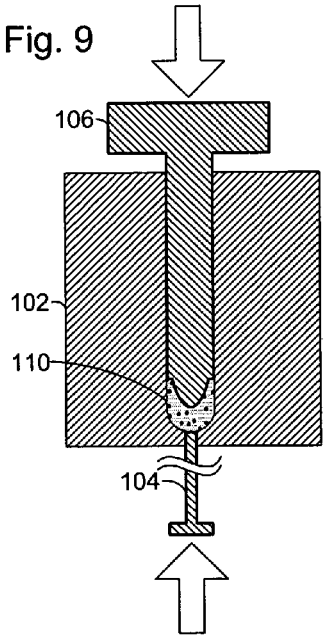

An illustrative example of a suitable method for compacting the powders or mixture of tungsten-containing powders and binder (which are generally referred to below as a powder mixture for purpose of brevity) is to use a die assembly. Die assemblies typically include at least one set of upper and lower punches that are selectively inserted into a cavity to apply pressure to the powder mixture and thereby define the shape of the compacted structure, which may be an intermediate structure, a compacted structure with the near net shape of the slug to be produced, or which may have the final shape of the slug. Any suitable die assembly may be used, including single-acting, double-acting, rotary, multi-punch, etc. For the purpose of illustration, an exemplary, somewhat simplified, or schematic, example of a compaction process is shown in FIGS. 8 and 9. The punches, dies and other structure shown in FIGS. 8 and 9, as well as in the subsequently described FIGS. 10 and 11, have been schematically illustrated. Accordingly, the relative dimensions of the dies and punches, the throw lengths of the punches, the depths of the dies, etc. may vary without departing from the scope of the disclosure.

Figure 10:
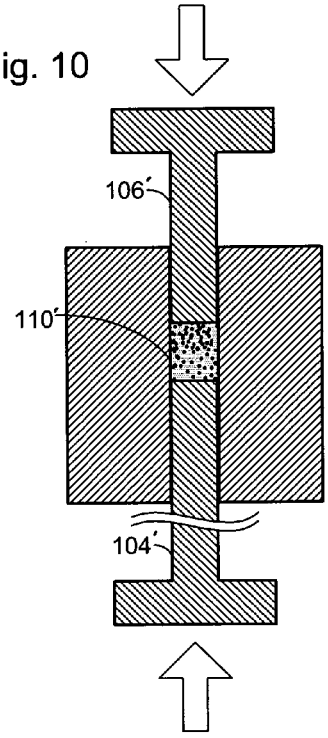
FIG. 10 is a schematic representation of a compacting process used to press an intermediate shape, which may be further worked to form a slug according to the present disclosure.

In FIG. 8, a NTLS mixture 100 of powders is placed in a die assembly 102 that includes a lower punch 104. After the desired amount of mixture 100 has been placed in the die assembly, an upper punch 106 is placed in position, as schematically shown in FIG. 9, and compacting pressure is applied to the powder mixture to yield a compacted structure 110. The compacted structure may have the final desired shape, or may alternatively be an intermediate structure 110' that has an intermediate shape, as shown in FIG. 10. If an intermediate shape is formed, the intermediate structure may be further worked, due to the characteristics of at least some of the NTLS compositions described and/or incorporated herein, to yield a slug with the final desired shape. Although an intermediate structure 110' having a generally cylindrical shape with opposed planar faces is within the scope of the disclosure, it is also within the scope of the disclosure to produce an intermediate structure having a shape that is closer to the desired final shape of the slug to be produced.

The compaction pressure applied during the compacting step may vary, but should be high enough to consolidate the powder mixture into a solid structure while reducing the microporosity of the composition, and thereby increasing the density of the composition. The applied pressure may stress the die assembly, including either of the punches, and therefore, dies and punches designed to withstand the pressure are desirable. Because the punches of FIG. 10 do not include knife edges, they may be better suited to withstand higher pressures than the punches of FIG. 11, particularly punch 104 of FIG. 11. Therefore, in some embodiments it may be desirable to first construct an intermediate shape that does not require the use of punches with knife edges or other features that may prematurely fail under high pressure. However, dies that compact the powder mixture into compacted structures having the final desired slug shape and that are constructed to withstand high pressures are within the scope of the disclosure.

The compacting step typically involves an applied pressure of approximately 40,000 psi or more, and often in the range of 50,000 psi and 100,000 psi or more. It should be understood that the particular compaction pressure to be applied will tend to vary with the composition of powder mixture 100, the shape of the compacted structure to be produced, the desired density to be achieved, and/or any additional processing steps to be performed before a finished slug 10 is produced. Therefore, and especially when a density of 11 g/cc–13 g/cc or more is desired, the applied pressure often is greater than approximately 50,000 psi, such as in the range of 50,000 psi and 100,000 psi, or 60,000 psi and 80,000 psi, and in some embodiments is preferably greater than approximately 75,000 psi.

As discussed, there is at least some relationship between the applied compaction pressure and the density of the resulting structure. It is within the scope of the disclosure that structures 110 or 110' may have essentially any selected density between 9 g/cc and 19.3 g/cc, depending upon the composition of mixture 100 and the amount of applied pressure. Typically, structures 110 or 110' will have a density that is at least equal to or near the density of lead, or a conventional lead alloy, and more commonly a density that is greater than lead, such as a density that is greater than 11.3 g/cc. In particular, a density of approximately 12 g/cc or more has been found to yield effective firearm slugs.

Figure 11:
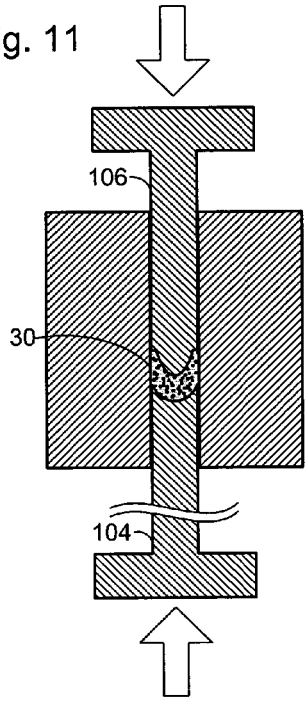
FIG. 11 is a schematic representation of another compacting process used to press slugs according to the present disclosure.

After compaction is completed, the upper punch may be cleared, and the lower punch may be extended to discharge the pressed slug or intermediate structure from the die assembly. However, this illustrative example is by no means intended to be an exclusive method for producing firearm slugs 10 according to the present disclosure, and it is within the scope of the disclosure to utilize other mechanisms for removing the compacted structures from the die assemblies. Although the compaction process is schematically illustrated as utilizing a single die assembly with both an upper and a lower punch, this arrangement is not required. For example, the compaction step may be accomplished with a die assembly having a cavity with a single opening and a single punch, or a multi-piece die in combination with one or two punches, or even a multi-cavity die with multiple single- or double-acting punches. Furthermore, the precise size and shape of the die and/or punches may be modified to yield a desired slug. As an example of a different possible arrangement, FIG. 11 schematically shows a die assembly configured to produce slug 30. Generally speaking, the manufacturing process may be simplified by using a die having a cavity with generally opposed openings and a pair of punches that are respectively adapted to be inserted into the openings.

As shown in FIG. 8 with respect to punch 104, each punch may include a head 112 that in turn includes a face 114 that is adapted to contact, or engage, and compact the NTLS mixture into the desired shape. The head and face may be made from a variety of materials, and tungsten carbide has been found to be particularly well suited for the face. By varying the size and shape of the die, and the shape and size of the punches (and corresponding faces), a broad variety of structures may be pressed to the desired density; including structures such as slugs 11, 30, and 50, and/or intermediate structures such as 110'. Of course, slugs 10 having dimensions other than that of slugs 11, 30, or 50 may also be produced. Similarly, other projectiles, such as bullets, or even articles other than projectiles, may be produced. To this end, the size and shape of the die and/or punches may be sized to correspond to the type and shape of projectile or other article to be produced therein, the amount of pressure to be applied, etc.

Figure 12:
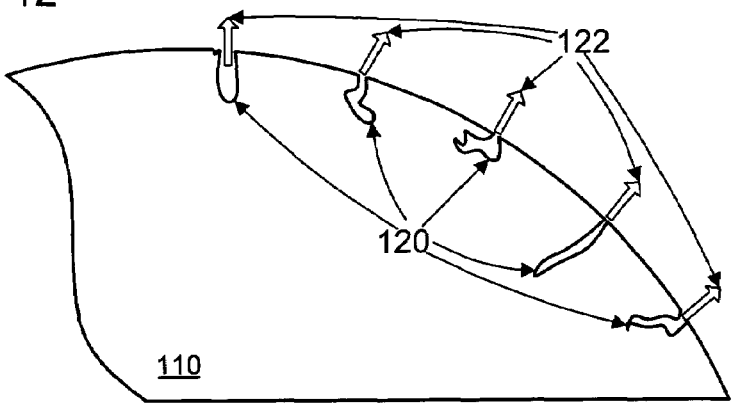
FIGS. 12 and 13 are schematic representations of a sealing process used to form slugs according to the present disclosure.
Figure 13:
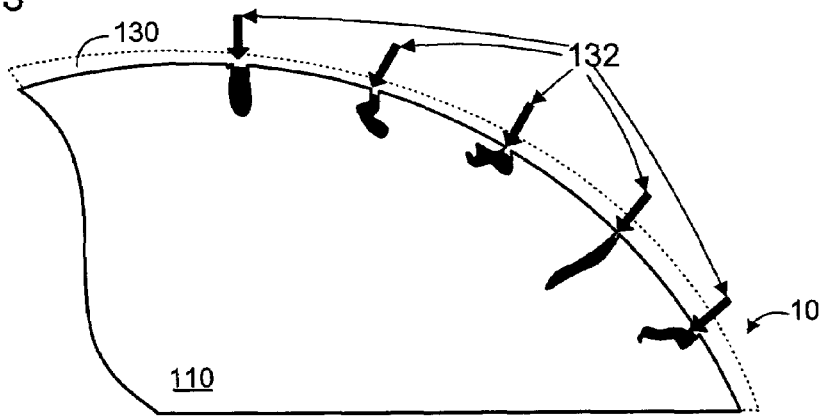

As is somewhat schematically shown in FIGS. 12 and 13, and as previously discussed with respect to FIG. 7, slugs 10 according to the present disclosure may be sealed after they have been pressed. Sealing infuses the slug with a chosen sealant, which is then cured or otherwise hardened, thereby reducing the porosity of the slug. Sealing also improves the surface quality of the slug, which facilitates plating the slug when plating is desired. Furthermore, the sealant increases the strength of the slug and therefore limits undesired breakup of the slug in many circumstances. For example, the sealant may improve the ability of the slug to resist disintegrating when exposed to the substantial energy and associated forces of being fired from a firearm. Similarly, when the intermediate structures are worked after the sealing step, such as to be grinded or sized, the sealing of the intermediate structures provides the structures with sufficient strength to withstand the forces imparted during this working without fragmenting or otherwise cracking or breaking into pieces. In some applications, the strength characteristics provided by sealing the slugs may alleviate the need to sinter the slug.

Sealed slugs (as well as unsealed slugs) may be configured as frangible slugs. In other words, sealing the compacted structures does not preclude the slugs from being frangible slugs. By frangible, it is meant that the slugs may desirably disintegrate, or at least substantially be returned to powder form, when impacting harder targets, such as many metal targets. Thus, the danger of the slug ricocheting is reduced. The sealant and/or the NTLS mixture may be selected to achieve a desired amount of frangibility, thus providing slugs suited for a particular purpose, such as law enforcement, military applications, target practice, or hunting. For example, a military or law enforcement slug and/or a target practice slug may be designed with a high degree of frangibility to reduce ricochet, while a hunting slug may be designed with less frangibility to increase penetration of the wound channel.

Different sealants may be used while remaining within the scope of various embodiments of the present disclosure. An example of a suitable sealant is a polymeric sealant. For example, RESINOL®, a low viscosity liquid polymer sealant formulated for water wash removal, has proven effective. Such a sealant is designed to cure anaerobically at room temperature, meaning it cures when deprived of oxygen/air. It is within the scope of the disclosure to use other sealants, and the above is provided as a non-limiting example. For example, other suitable sealants include rigid acrylics, methacrylates, and other epoxies. As another example, other suitable polymeric sealants are cured or cross-linked through the application of water or heat. Examples of heat-curable sealants include thermoset and thermoplastic resins or polymers, such as LOC-TITE® epoxies. Still other non-metal sealants, such as sodium silicate, solidify from a liquid state through crystallization. Still another example of a suitable sealant is a metal sealant, which is introduced, or infiltrated, into the compacted structure in a liquid or molten state, and thereafter allowed to solidify.

A graphical, schematic example of a sealing process is shown in FIGS. 12 and 13. FIG. 12 provides a schematic view of a portion of compacted structure 110, which forms slug 10 after the sealing process or after further processing after the sealing process. FIG. 12 schematically shows pores 120 of the slug, with the pores being exaggerated to better illustrate the sealing process. A sealant may be introduced to structure 110, or a group of compacted structures, via a vacuum impregnation process or other suitable process for infiltrating the sealant into the pores. Vacuum impregnation typically includes evacuating air from the internal porosity of the slug, as schematically illustrated by arrows 122. For example, the compacted structures may be immersed in a sealant 130, which is schematically represented by dashed lines in FIG. 13. The evacuation of the pores creates a pressure differential that encourages the sealant to flow into the pores, as is schematically shown by arrows 132. A capillary effect or application of positive pressure may further encourage flow of the sealant into the pores. As the infiltration of the sealant corresponds to a removal of air from the pores, the bulk density of the compacted structure is increased. Furthermore, and as discussed, the sealant increases the overall strength of the compacted structure. Because the sealant is purposefully infiltrated into the compacted structure, it adds strength to the intermediate structure (and finished slug) at a subsurface level.

After the pores have been impregnated with sealant, the sealant is then solidified or otherwise hardened. For example, in the case of a polymer sealant, the sealant is polymerized or cross-linked to form a solid polymer. In some embodiments, a catalyst bath may be used to facilitate setting the polymer. Although the sealant internally seals the pores of the intermediate structure, which may now be referred to as a slug 10 if no further processing is applied, the slug remains substantially unchanged cosmetically and dimensionally. The film of sealant remaining on the surface of structure 110 (or slug 10) may be retained to provide a surface coating, but it is often removed via any suitable process. For example, the residual coating of the illustrative polymeric sealant discussed above may be removed by rinsing the structure/slug with water or other suitable solvents, such as depending upon the particular sealant being used. As discussed, vacuum impregnation may not be appropriate for some sealants, and it is within the scope of the disclosure to implement other sealing techniques when appropriate. Similarly, other curing techniques may be used. For example, heat curing or water curing may be desirable when using certain sealants and/or NTLS mixtures.

Figure 14:
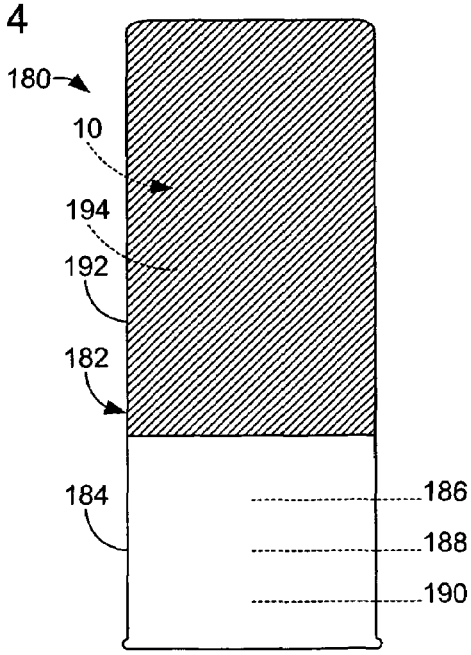
FIG. 14 is an elevation view of a slug cartridge containing a firearm slug according to the present disclosure.

As shown in FIG. 14, slug 10 may be a constituent element of a slug cartridge, or shotgun cartridge, 180. Slug cartridge 180 may also be referred to as a slug shell. As shown, cartridge 180 includes a case, or casing, 182. Casing 182 includes a base 184, which is typically formed from metal and houses the cartridge's wad 186, charge 188 and primer, or priming mixture, 190. The casing also includes a hull, or slug-region, 192 that is typically formed from plastic or another suitable non-metallic component and which defines a chamber 194 into which a slug 10 is housed. The top of the hull is typically crimped closed, although other constructions and sealing methods may be used, including a construction in which the top of the hull forms a band with an opening having a smaller diameter than the slug and which is positioned over at least a portion of the nose of the slug. As discussed, a conventional slug cartridge is designed to house a single slug, which according to the present disclosure will be any of the slugs 10 described, illustrated and/or incorporated herein. It is within the scope of the disclosure that cartridge 180 may include other constituent elements, as are conventional or otherwise known in the field of slug cartridge construction.

Figure 15:
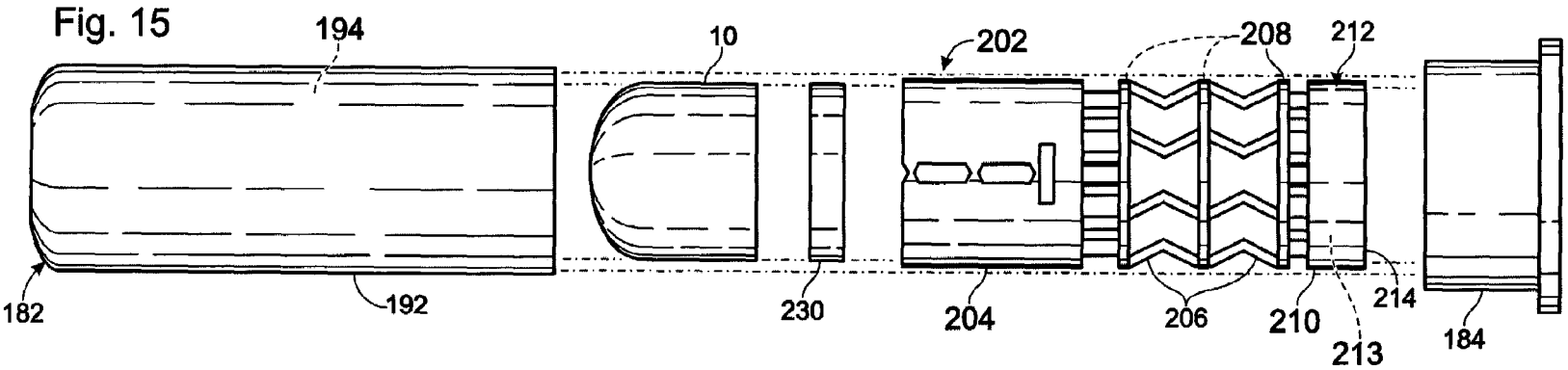
FIG. 15 is an exploded elevation view of a portion of a slug cartridge that includes a slug cup and a firearm slug.
Figure 16:
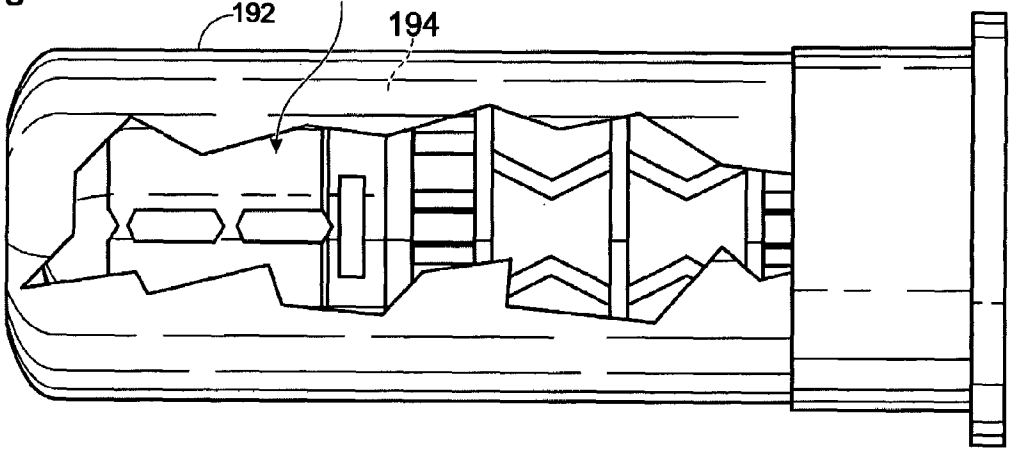
FIG. 16 is a fragmentary assembled view of the slug cartridge of FIG. 15.

Shotgun cartridges that contain a shot slug may, but are not required to, include a slug cup within chamber 194. An example of a suitable slug cup is shown in FIGS. 15 and 16 and indicated generally at 202. Slug cup 202 is configured to receive and house a slug 10 in a slug-engaging portion 204. Slug-engaging portion 204 may be shaped to closely correspond to the shape of slug 10. In particular, in some embodiments, the slug-engaging portion may include ridges (not shown) complementarily configured relative to corresponding grooves on the surface of the slug. Such ridges may be located on the outer surface of the slug, the inner surface of a rear internal recess, and/or at the tail end of the slug. Other mechanical and/or non-mechanical engagement mechanisms are within the scope of the disclosure. For example, these mechanisms include mechanisms in which the slug is seated within the slug cup but not mechanically locked or fixed relative to the slug cup, as well as mechanisms that are configured to create an enhanced friction between the slug and the cup, thus causing the slug to spin when the cup spins. To this end, the cup may be constructed to engage the rifling of a barrel. For example, the cup may be constructed from a material suitable for being fired down a barrel while engaging the rifling of the barrel. It has been found that nylon is well suited for engaging rifled barrels, although other materials may be used, such as polyethylene. The thickness of the cup may be dimensioned to increase the ability of the rifled barrel to impart spin on the cup and the slug. Furthermore, the cup may be configured for use in non-rifled barrels, and in some embodiments the same slug cartridge may be used in both rifled barrels and non-rifled barrels. The slug cup limits direct physical contact between the slug and the rifling, thus limiting potential harm the slug may cause to the rifling, especially in embodiments that do not utilize plating, which also may be used for engaging and/or protecting rifled barrels.

In FIG. 15, cup 202 is also shown with optional cushioning, or shock-absorbing, portion 206 and at least one gas seal 208. The cushioning portion may be utilized to lessen the initial forces delivered to the slug when the slug is fired. However, it is within the scope of various embodiments of the present disclosure to construct a slug cartridge without such a cushioning portion. A gas seal 208 may be attached to a firing cup 210. The firing cup and the gas seal may collectively define a charge volume 212, which may be used to hold a charge 213, such as a quantity of gunpowder. The firing cup may include a primer, such as schematically shown at 214, which facilitates controlled ignition of the charge when firing the slug.

As discussed, slug cartridge 180 also includes a casing 182 that includes a hull 192. Hull 192 may be approximately one to four inches long, and is configured to securely attach to the firing cup, which typically includes the primer. The hull extends from the firing cup around the slug cup and the slug. The hull may be roll crimped around the slug, or otherwise fastened about the slug. The hull is typically constructed from a plastic material, such as polyethylene, although other materials are within the scope of the disclosure.

The slug cartridge may further include a force distributor 230. In particular, force distributor 230 may be particularly suitable in embodiments in which slug 10 is frangible and/or includes a rear internal recess. The force distributor may be configured to withstand the force of firing, more evenly distribute the force of firing to the slug and/or limit clogging of the rear internal recess, such as with portions of the slug cup. The force distributor is typically constructed from a relatively rigid material, such as nylon or another strong polymer, thus limiting deformation of the force distributor when the slug is fired.

Slugs 10 according to the present disclosure may also be utilized in slug cartridges that include a sabot. Similar to the slug cup, a sabot at least partially encloses the slug while the slug is in the slug cartridge and after firing of the cartridge while the slug is still within the barrel of the firearm. However, once the slug has cleared the barrel, sabots may be designed to remain with or to separate from the slug. A sabot may be used to enhance rotation of the slug by providing a physical linkage between the rifling of a barrel and the slug. When a slug cup or a sabot is used, the diameter of the slug may be decreased to limit physical contact of the slug with the rifling of the barrel, where such contact may damage the rifling. However, the slug cup or the sabot may compensate for the smaller diameter, and may simultaneously engage the rifling and the slug. Therefore, the rifling may cause the slug cup or the sabot to spin, which in turn may cause the slug to spin. Because the slug cup or the sabot is typically constructed from material substantially softer than the pressed NTLS composition of a slug, damage to the rifling of a barrel is at least limited, and usually eliminated altogether. As described above, a slug cartridge constructed according to embodiments of the present disclosure may be used in either a rifled barrel or a non-rifled barrel.

As discussed above, slugs according to various embodiments of the present disclosure may be constructed using a variety of NTLS compositions. Examples of suitable NTLS compositions and methods for forming the compositions are disclosed in U.S. Pat. Nos. 6,447,715, 6,248,150, 6,270,549, in U.S. Patent Application Publication No. 20020124759 (Ser. No. 10/041,873), in U.S. Provisional Patent Application Ser. No. 60/462,164, and in U.S. patent application Ser. No. 10/688,071, which was filed on Oct. 17, 2003 and is entitled "Tungsten-Containing Articles and Methods for Forming the Same," the complete disclosures of which are hereby incorporated by reference for all purposes.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Where the disclosure or subsequently filed claims recite "a" or "a first" element or the equivalent thereof, it should be within the scope of the present inventions that such disclosure or claims may be understood to include incorporation of one or more such elements, neither requiring nor excluding two or more such elements.

Applicant reserves the right to submit claims directed to certain combinations and subcombinations that are directed to one of the disclosed inventions and are believed to be novel and non-obvious. Inventions embodied in other combinations and subcombinations of features, functions, elements and/or properties may be claimed through amendment of those claims or presentation of new claims in that or a related application. Such amended or new claims, whether they are directed to a different invention or directed to the same invention, whether different, broader, narrower or equal in scope to the original claims, are also regarded as included within the subject matter of the inventions of the present disclosure.

What is claimed is:

1. A tungsten-containing powder-based shot slug, comprising:

a body including:

a nose portion configured to first leave a barrel of a firearm from which the slug is fired, and a base portion configured to trail the nose portion through the barrel of the firearm from which the slug is fired, wherein the base portion includes an outer skirt that laterally defines a rear internal recess extending into the body; and wherein the body is formed via powder metallurgy from at least a tungsten-containing component and a binder, and further wherein the body includes an outer surface and a sealant infiltrated beneath the outer surface.

2. The shot slug of claim 1, wherein the body is forward-weighted, with the nose portion containing a majority amount of the body's mass.

3. The shot slug of claim 2, wherein the nose portion defines a front internal recess extending into the body.

4. The shot slug of claim 2, wherein the nose portion does not include a front internal recess extending into the body.

5. The shot slug of claim 2, wherein the outer skirt is tapered.

6. The shot slug of claim 2, wherein the outer skirt defines an outer perimeter that at least substantially corresponds to the diameter of a firearm barrel from which the shot slug is fired.

7. The shot slug of claim 2, wherein the rear internal recess extends at least 20% of the slug's length.

8. The shot slug of claim 2, wherein at least a portion of the body has an outer diameter that is dimensioned so that the barrel of the firearm from which the slug is fired imparts ballistic control to the slug.

9. The shot slug of claim 2, wherein the slug has a density in the range of 10.9 grams/cubic-centimeter and 11.7 grams/cubic-centimeter.

10. The shot slug of claim 2, wherein the slug has a density in the range of 8 grams/cubic-centimeter to 11 grams/cubic-centimeter.

11. The shot slug of claim 2, wherein the slug has a density in the range of 11.5 grams/cubic-centimeter and 17 grams/cubic-centimeter.

12. The shot slug of claim 2, wherein the tungsten-containing component includes an alloy of tungsten, nickel and iron.

13. The shot slug of claim 2, wherein the tungsten-containing component includes tungsten and iron.

14. The shot slug of claim 2, wherein the binder includes tin.

15. The shot slug of claim 14, wherein the binder further includes a polymeric binder.

16. The shot slug of claim 2, wherein the body is frangible.

17. The shot slug of claim 2, wherein the body includes a shoulder generally between the nose portion and the base portion.

18. The shot slug of claim 17, wherein the shoulder defines a plane extending transverse to a central axis of the slug.

19. A shot-slug cartridge containing the shot slug of claim 2.

20. The shot slug of claim 1, wherein the nose portion defines a front internal recess extending into the body.

21. The shot slug of claim 20, wherein the front internal recess extends at least 5% of the slug's length.

22. The shot slug of claim 1, wherein the nose portion does not include a front internal recess extending into the body.

23. The shot slug of claim 1, wherein the outer skirt is tapered.

24. The shot slug of claim 1, wherein the outer skirt defines an outer perimeter that at least substantially corresponds to the diameter of a firearm barrel from which the shot slug is fired.

25. The shot slug of claim 1, wherein the rear internal recess extends at least 20% of the slug's length.

26. The shot slug of claim 1, wherein the rear internal recess extends at least 40% of the slug's length.

27. The shot slug of claim 1, wherein at least a portion of the body has an outer diameter that is dimensioned so that the barrel of the firearm from which the slug is fired imparts ballistic control to the slug.

28. The shot slug of claim 1, wherein the slug has a density in the range of 10.9 grams/cubic-centimeter and 11.7 grams/cubic-centimeter.

29. The shot slug of claim 1, wherein the slug has a density in the range of 8 grams/cubic-centimeter to 11 grams/cubic-centimeter.

30. The shot slug of claim 1, wherein the slug has a density in the range of 11.5 grams/cubic-centimeter and 17 grams/cubic-centimeter.

31. The shot slug of claim 1, wherein the tungsten-containing component includes an alloy of tungsten, nickel and iron.

32. The shot slug of claim 1, wherein the tungsten-containing component includes tungsten and iron.

33. The shot slug of claim 1, wherein the binder includes tin.

34. The shot slug of claim 33, wherein the binder further includes a polymeric binder.

35. The shot slug of claim 34, wherein the polymeric binder includes a thermoset epoxy.

36. The shot slug of claim 1, wherein the binder includes a polymeric binder.

37. The shot slug of claim 1, wherein the body is frangible.

38. The shot slug of claim 1, wherein the sealant includes a heat-curable sealant.

39. The shot slug of claim 1, wherein the sealant is adapted to be cured by exposing the sealant to an anaerobic environment.

40. The shot slug of claim 1, wherein the body includes a shoulder generally between the nose portion and the base portion.

41. The shot slug of claim 40, wherein the shoulder defines a plane extending transverse to a central axis of the slug.

42. The shot slug of claim 1, wherein the body is formed from non-toxic, lead-free materials.

43. A shot-slug cartridge containing the shot slug of claim 1.

* * * * *